US012654092B1

(12) United States Patent
Wood Ham et al.

(10) Patent No.: US 12,654,092 B1
(45) Date of Patent: Jun. 16, 2026

(54) PORTABLE GAME BOARD FOR CARD PLAYING

(71) Applicant: Sarah Louise Wood Ham, Metairie, LA (US)

(72) Inventors: Sarah Louise Wood Ham, Metairie, LA (US); Elise Kiser, Metairie, LA (US)

(73) Assignee: Sarah Louise Wood Ham, Metairie, LA (US)

( * ) Notice: Subject to any disclaimer, the term of this patent is extended or adjusted under 35 U.S.C. 154(b) by 370 days.

(21) Appl. No.: 18/512,588

(22) Filed: Nov. 17, 2023

(51) Int. Cl.
*A63F 1/06* (2006.01)
*A63F 3/00* (2006.01)

(52) U.S. Cl.
CPC ..... *A63F 3/0023* (2013.01); *A63F 1/06* (2013.01); *A63F 3/00261* (2013.01); *A63F 2003/00233* (2013.01); *A63F 2250/20* (2013.01)

(58) Field of Classification Search
CPC .... A63F 1/06; A63F 1/10; A63F 2003/00255; A63F 2250/20; A63F 2003/00233
See application file for complete search history.

(56) References Cited

U.S. PATENT DOCUMENTS 2,450,325 A * 9/1948 Zirin ..... A63F 1/06 273/285
4,184,684 A * 1/1980 Cramer ..... A63F 9/06 273/148 A
2023/0166177 A1* 6/2023 Stetar ..... B32B 25/12 428/492

FOREIGN PATENT DOCUMENTS

EP 3919144 A1 * 12/2021 ..... A63F 1/10
GB 2122098 A * 1/1984 ..... A63F 1/10

* cited by examiner

*Primary Examiner* — Laura Davison

(57) ABSTRACT

A portable game board for card playing includes a first rigid body and a second rigid body which are pivotally moveable between a folded position and an open card playing position. The portable game board includes a plurality of flat card retention sleeves adapted to receive playing cards of a user, and each flat card retention sleeve is disposed atop an inner playing surface along respective outer edges of the portable game board. Each flat card retention sleeve is adapted to resist unintentional disengagement of playing cards when inserted between the respective flat card retention sleeve and the inner playing surface. An elongated flexible band is disposed across a top of the inner playing surface, where it flexibly engages the inner playing surface and is designed to resist unintentional disengagement of a second plurality of playing cards when inserted between the elongated flexible band and the inner playing surface.

14 Claims, 8 Drawing Sheets

PORTABLE GAME BOARD FOR CARD PLAYING

BACKGROUND OF THE INVENTION

Field of the Invention

The present invention relates generally to game boards and more particularly to a card playing game board for outdoors.

Description of the Related Art

People often engage in playing cards during their free time. Playing cards can be enjoyed by individuals of all ages, making card games a versatile pastime suitable for families, friends, and various social groups. Card games offer educational benefits, such as enhancing math skills, strategic thinking, and logical reasoning. Players often have to calculate probabilities, make decisions based on available information, and devise strategies to win. Playing cards is also known to have stress-relieving qualities. People relax and unwind, reducing stress and anxiety by playing cards.

Most people enjoy playing cards outdoors such as at beach, near pools, camping, on patios and more to enjoy fresh air and a change of scenery. However, playing cards outdoors can present challenges, especially when there is a breeze or wind. It can be nearly impossible to play cards as even the slightest breeze can disrupt the game by blowing cards away. The disruption can lead to frustration among the players, as it can be challenging to keep the cards in place and maintain the integrity of the game.

Over the years, various devices have been made to assist people with playing card games outdoors. The solutions typically involve alternative types of cards or card-like tiles. One approach has been the creation of magnetic cards or card tiles that resemble dominoes. However, magnetic cards and tiles are bulky and provide a lack of flexibility such as easy shuffling and manipulation during a game. Magnetic cards, in particular, can be difficult to shuffle compared to regular playing cards. Further, specialized cards or domino-like tiles are not as readily accessible as regular playing cards.

None of the existing cards or card solutions provide a convenient, effective, and efficient way to play card games outdoors particularly when there is a strong breeze.

A need also exists for a device that provides a large, smooth, flat, square surface which is ideal for playing cards. There is a need for a device that allows card lovers to enjoy being outdoors while playing their favorite card games without worrying about wind blowing away their cards.

While conventional cards and card game boards may be suitable for playing card games indoors, they would not be as suitable for the purposes of the present invention as disclosed hereafter. None of such conventional devices disclose the unique structures and advantages of the present disclosure. The devices disclosed herein avoid many of the drawbacks of existing devices.

Accordingly, there is a need for improved and foldable card game board that facilitates card games to be played outdoors without the cards being blown away by wind.

It is one prospect of the present invention to provide a novel portable card game board of simple but effective construction for convenient and efficient card games outdoors even in a strong breeze.

Another object of the present invention is to provide a portable game board that can be folded easily allowing a user to carry and store the game board easily.

Yet another object of the disclosed invention is to provide a portable game board that includes sleeves and a band for securing the cards during a game without fear of unintentional disengagement of playing cards.

As disclosed in this application, the inventor has discovered novel and unique portable game board for efficiently and effectively playing card games at the beach, boating, camping, on patios, porches, balconies, and more.

Embodiments of the present invention provide for a portable card game board as described and defined in the description below and in the annexed claims which exhibits superlative properties and provides for improved efficiency and enjoyment when conveniently and effectively playing card games outdoors.

SUMMARY OF THE INVENTION

The following presents a simplified summary of the present disclosure in a simplified form as a prelude to the more detailed description that is presented herein.

Therefore, in accordance with embodiments of the invention, there is provided a portable game board for playing cards. The portable game board is designed to be in an open card playing position for playing a card game and in a folded position for easy transportation and storage. The portable game board comprises a first rigid planar body foldably connected to a second rigid planar body. The portable game board has an inner playing surface opposite an outer surface. The first and second rigid bodies are pivotally moveable between a folded position and an open card playing position. In the folded position, the first rigid body opposes the second rigid planar body. In the open card playing position, the first rigid body is in coplanar alignment with the second rigid body.

Preferably, the portable game board includes a plurality of flat card retention sleeves adapted to receive playing cards of a user. Each flat card retention sleeve is disposed atop the inner playing surface along a respective outer edge of the portable game board. In a preferred embodiment, the portable game board includes four flat card retention sleeves and four outer edges, with one of the four flat card retention sleeves disposed at each respective outer edge. Each flat card retention sleeve is adapted to resist unintentional disengagement of a first plurality of playing cards when one or more playing cards of the first plurality of playing cards is inserted inside the one of the flat card retention sleeves.

In a preferred embodiment, the portable game board includes an elongated flexible band. The flexible band is disposed across a top of the inner playing surface of the first rigid body and the second rigid body. The elongated flexible band is adapted to resist unintentional disengagement of a second plurality of playing cards when inserted between the elongated flexible band and the inner playing surface.

In a preferred embodiment, the first rigid body and the second rigid body are each rectangular in shape.

In a preferred embodiment, the portable game board is square in shape in the open card playing position.

In yet another preferred embodiment, the portable game board comprises a superellipse shape when in an open card playing position.

In one embodiment, the first rigid body and the second rigid body are each semicircular in shape.

In another embodiment, the portable game board is round in shape in the open card playing position.

In one embodiment, each flat card retention sleeve is constructed of a flexible material.

In another embodiment, each flat playing card retention sleeve is one of transparent and opaque.

In preferred embodiment, the elongated flexible band has a first end, a second end opposite the first end, and a middle portion disposed between the first end and the second end.

In a preferred embodiment, the first end, the middle portion, and the second end are each respectively fixed to the playing surface of the portable game board, and the elongated flexible band flexibly engages the inner playing surface of the first rigid planar body and the second rigid planar body, where the elongated flexible band is adapted to resist disengagement of playing cards when inserted between the elongated flexible and the inner playing surface.

In preferred embodiment, the first end of the flexible band is fixed to a first corner of the inner playing surface, wherein the middle portion is fixed to a center of the playing surface, wherein the second end is fixed to a second corner of the inner playing surface opposite the first corner.

These and other features, aspects, and advantages of the present invention will become better understood with reference to the following description and appended claims.

BRIEF DESCRIPTION OF THE DRAWINGS

Illustrative embodiments of the present invention are described herein with reference to the accompanying drawings, in which.

DETAILED DESCRIPTION

Figure 1:
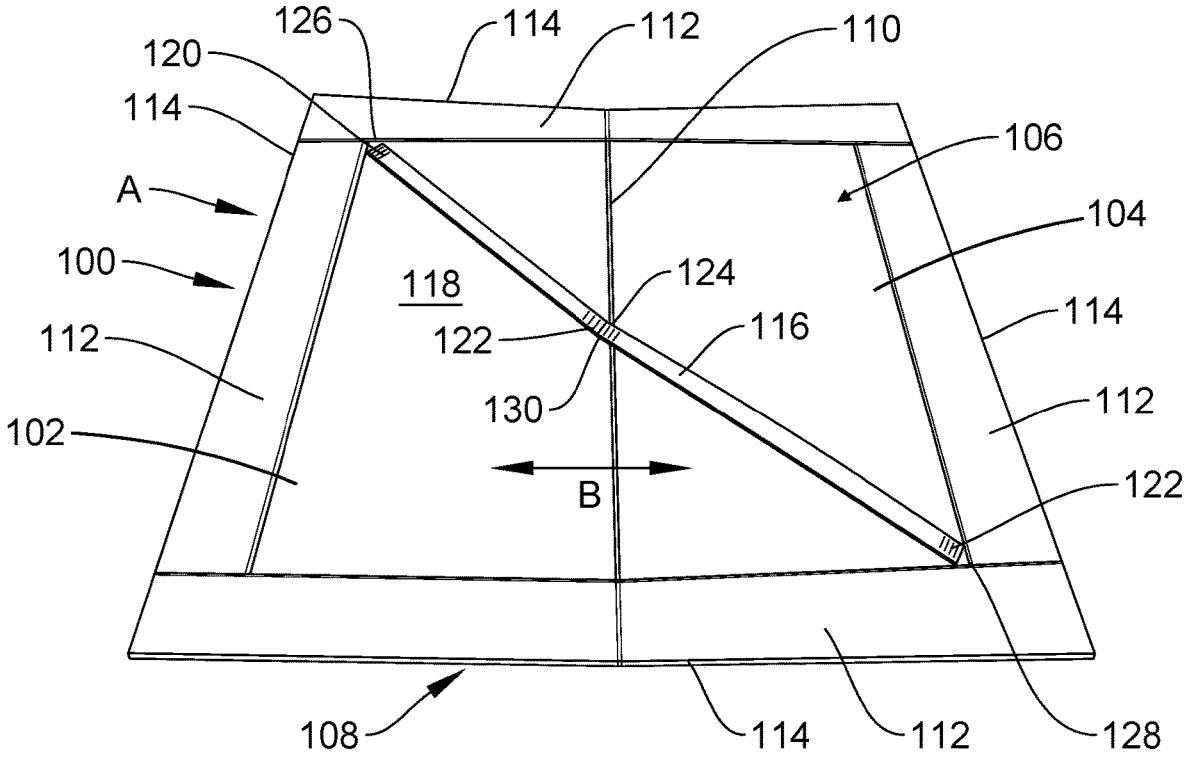
FIG. 1 illustrates the portable game board for playing cards in an open card playing position, in accordance with embodiments of the invention.

For a further understanding of the nature and function of the embodiments, reference should be made to the following detailed description. Detailed descriptions of the embodiments are provided herein, as well as, the best mode of carrying out and employing the present invention. It will be readily appreciated that the embodiments are well adapted to carry out and obtain the ends and features mentioned as well as those inherent herein. It is to be understood, however, that the present invention may be embodied in various forms. Therefore, persons of ordinary skill in the art will realize that the following disclosure is illustrative only and not in any way limiting, as the specific details disclosed herein provide a basis for the claims and a representative basis for teaching to employ the present invention in virtually any appropriately detailed system, structure or manner. It should be understood that the devices, materials, methods, procedures, and techniques described herein are presently representative of various embodiments. Other embodiments of the disclosure will readily suggest themselves to such skilled persons having the benefit of this disclosure.

Reference will now be made in detail to the present preferred embodiments of the invention, examples of which are illustrated in the accompanying drawings. Wherever possible, the same reference numerals are used in the drawings and the description to refer to the same or like parts.

Referring initially to FIGS. 1-7, the basic constructional details and principles of operation of embodiments of a portable game board 100 are provided.

As illustrated in FIG. 1, in a preferred embodiment, the disclosed portable game board 100 includes a first rigid planar body 102 and a second rigid planar body 104. Both the first rigid planar body 102 and the second rigid planar body 104 are generally rectangular. The first rigid planar body 102 and the second rigid planar body 104 are in an open card playing position (Arrow A, FIG. 1) for allowing a plurality of players to play different card games. Preferably, the first rigid planar body 102 and the second rigid planar body 104 are symmetrical and substantially similar in size. In a preferred embodiment, in the open card playing position (Arrow A, FIG. 1), the first rigid planar body 102 is in coplanar alignment (Arrow B, FIG. 1) with the second rigid planar body 104, and the portable game board 100 is square in shape.

Figure 2A:
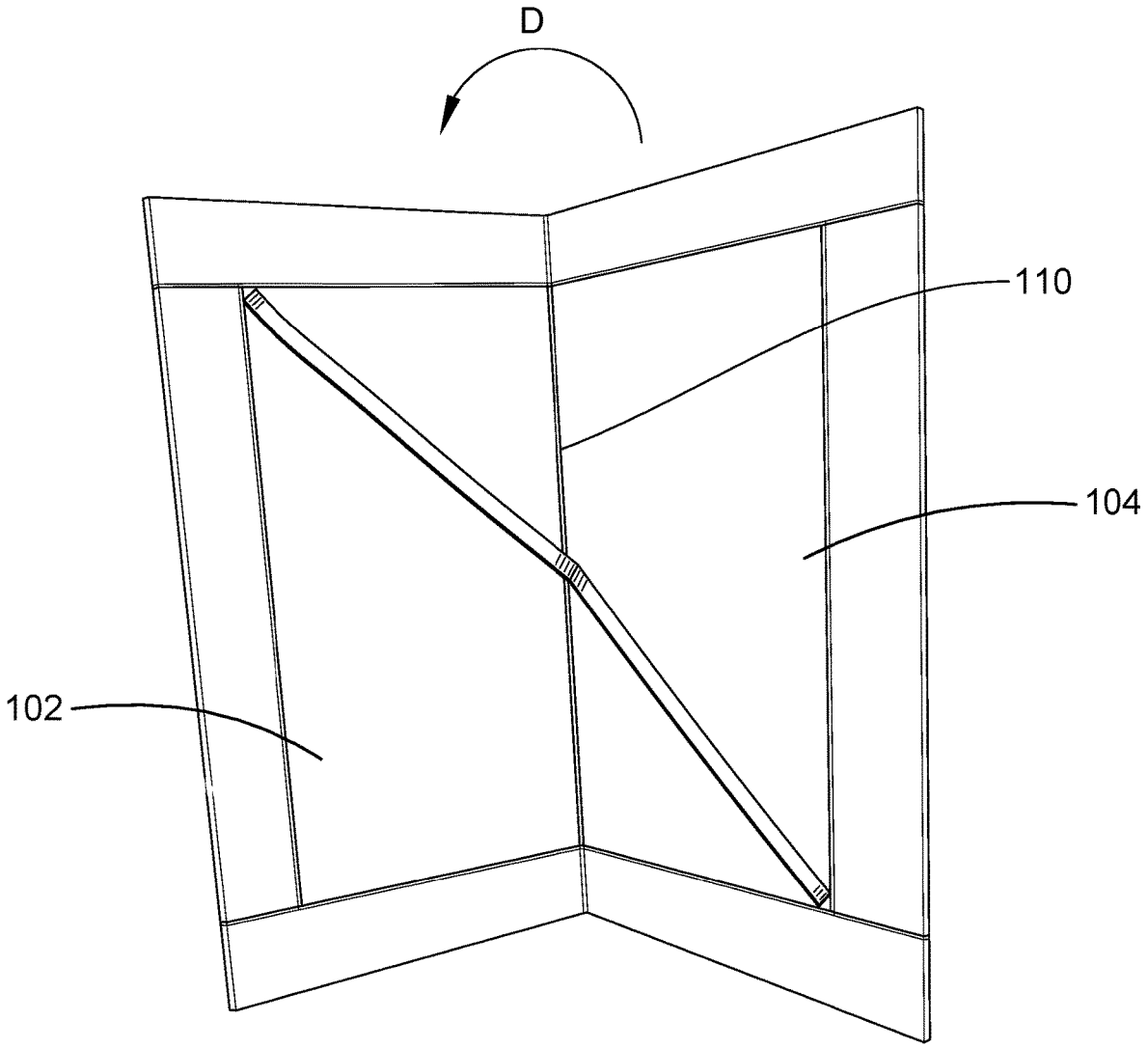
FIG. 2A illustrates folding of the portable game board, in accordance with embodiments of the invention.
Figure 2B:
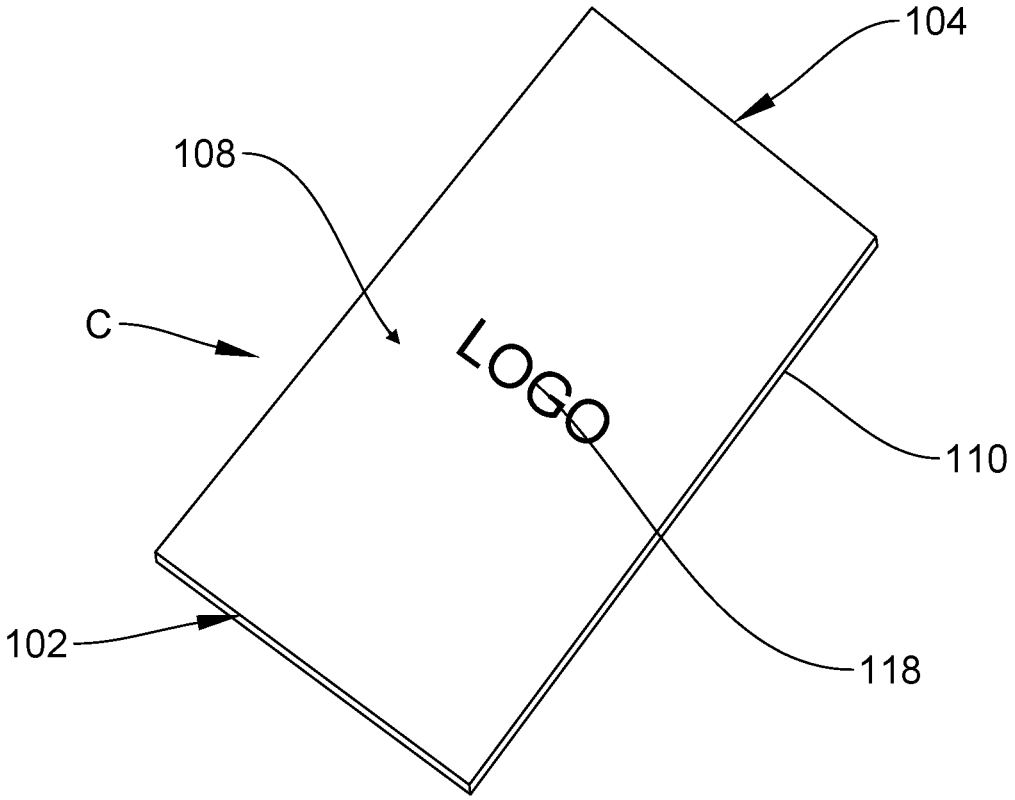
FIG. 2B illustrates the portable game board for playing cards in a folded position, in accordance with embodiments of the invention.

An inner playing surface 106 of the portable game board 100 is used for playing card games while the portable game board 100 is in the open card playing position (Arrow A, FIG. 1), and the portable game board 100 has an opposite outer surface 108, as illustrated in FIG. 2B. The inner playing surface 106 spans across the first rigid planar body 102 and the second rigid planar body 104, as exemplified in FIGS. 1, 3 and 5.

Referring now to FIGS. 1, 2A and 2B, the first rigid planar body 102 and the second rigid planar body 104 are pivotally moveable (Arrow D, FIG. 2A) to a folded position (Arrow C, FIG. 2B) from the open card playing position (Arrow A, FIG. 1). The first rigid planar body 102 and the second rigid planar body 104 are pivotally move along the folding seam 110, which is preferably positioned along a center of the portable game board 100, as illustrated in FIGS. 1, 2A and 2B. In the folded position, the first rigid planar body 102 opposes the second rigid planar body 104, as seen in FIG. 2. In a preferred embodiment, in the folded position (Arrow C, FIG. 2B), the portable game board 100 is rectangular in shape. The outer surface 108 preferably includes a logo or any other indicia 118 for branding or marketing purposes, as exemplified in FIG. 2B.

Figure 3:
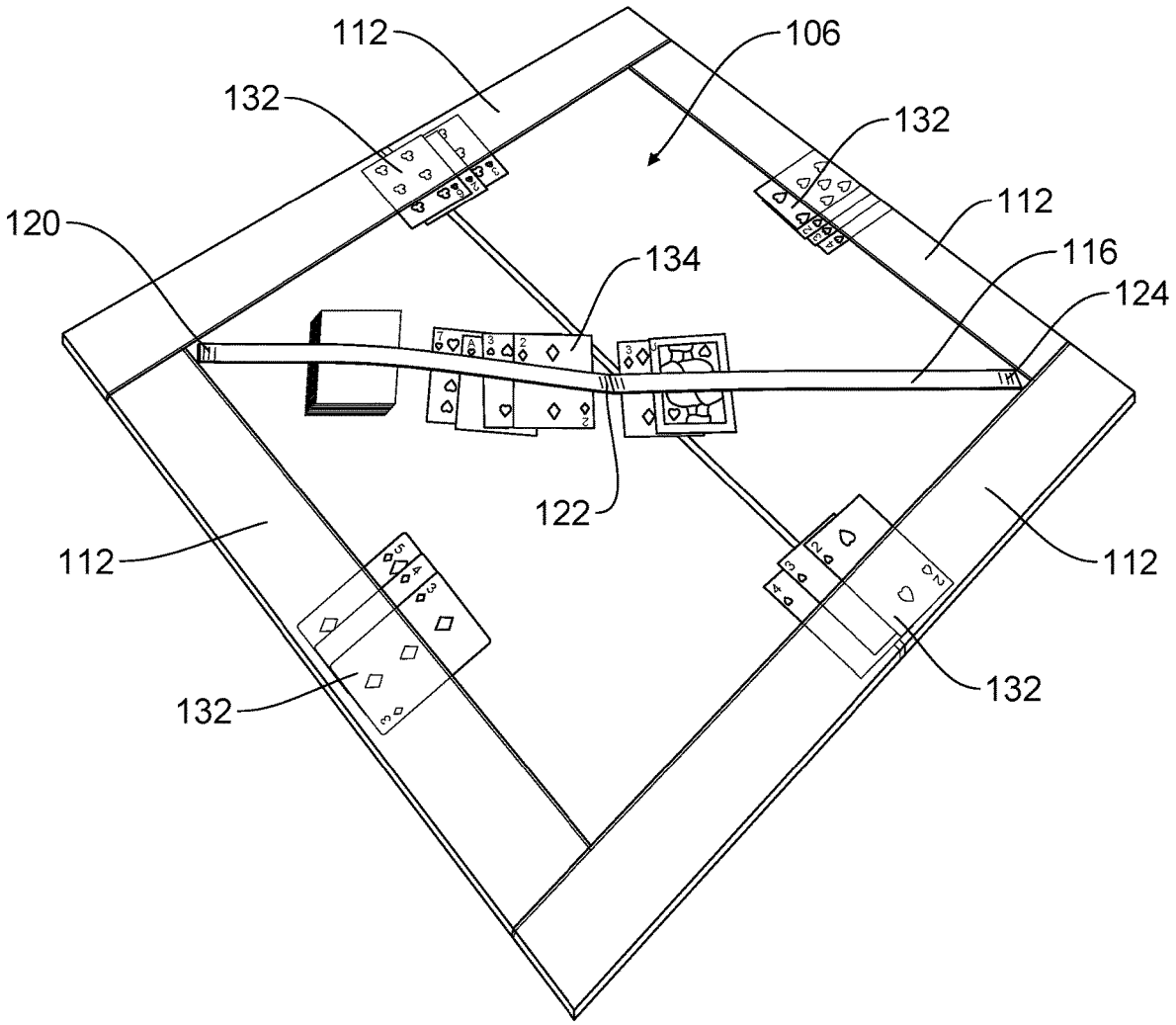
FIG. 3 illustrates the portable game board in the open card playing position, with cards secured in the flat card retention sleeves and elongated flexible band in accordance with embodiments of the invention.

Referring now to FIGS. 1 and 3, a plurality of flat card retention sleeves 112 adapted to receive playing cards 132 of a user 136 are disposed atop the inner playing surface 106 of the portable game board 100. More specifically, each flat card retention sleeve 112 is preferably disposed along a respective outer edge 114 of the portable game board 100. Each flat card retention sleeve 112 is adapted to resist unintentional disengagement of a first plurality of playing cards 132 when inserted and kept inside the flat card retention sleeve 112, between the respective the flat card retention sleeve 112 and the inner playing surface 106. The respective flat card retention sleeve 112 retains the respectively inserted playing card.

In some embodiments of the invention, each flat card retention sleeve 112 is constructed of a flexible material such as rubber, silicon, plastic and the like. The flat card retention sleeves 112 can be designed as transparent, translucent, or opaque, to meet the requirements of different users. In one embodiment, the plurality of flat card retention sleeves 112 are fabricated as a single flat retention sleeve disposed atop the inner playing surface 106 around the outer edges of the of the portable game board 100.

Referring again to FIGS. 1 and 3, the portable game board 100 preferably includes an elongated flexible band 116 disposed across a top of the inner playing surface 106 of the first rigid planar body 102 and the second rigid planar body 104. The elongated flexible band 116 has a first end 120, a second end 122 opposite to the first end 120, and a middle portion 124 disposed between the first end 120 and the second end 122. The elongated flexible band 116 flexibly engages the inner playing surface 106 of the first rigid planar body 102 and the second rigid planar body 104.

The first end 120 of the flexible band 116 is preferably fixed to a first corner 126 of the inner playing surface 106 of the portable game board 100, and the opposite second end 122 of the flexible band 116 is preferably fixed to a diagonally opposite corner 128 of the inner playing surface 106 of the portable game board 100. The middle portion 124 of the flexible band 116 is preferably fixed to the center 130 of the inner playing surface 106, as illustrated in FIGS. 1, 2A, 3 and 5.

Figure 5:
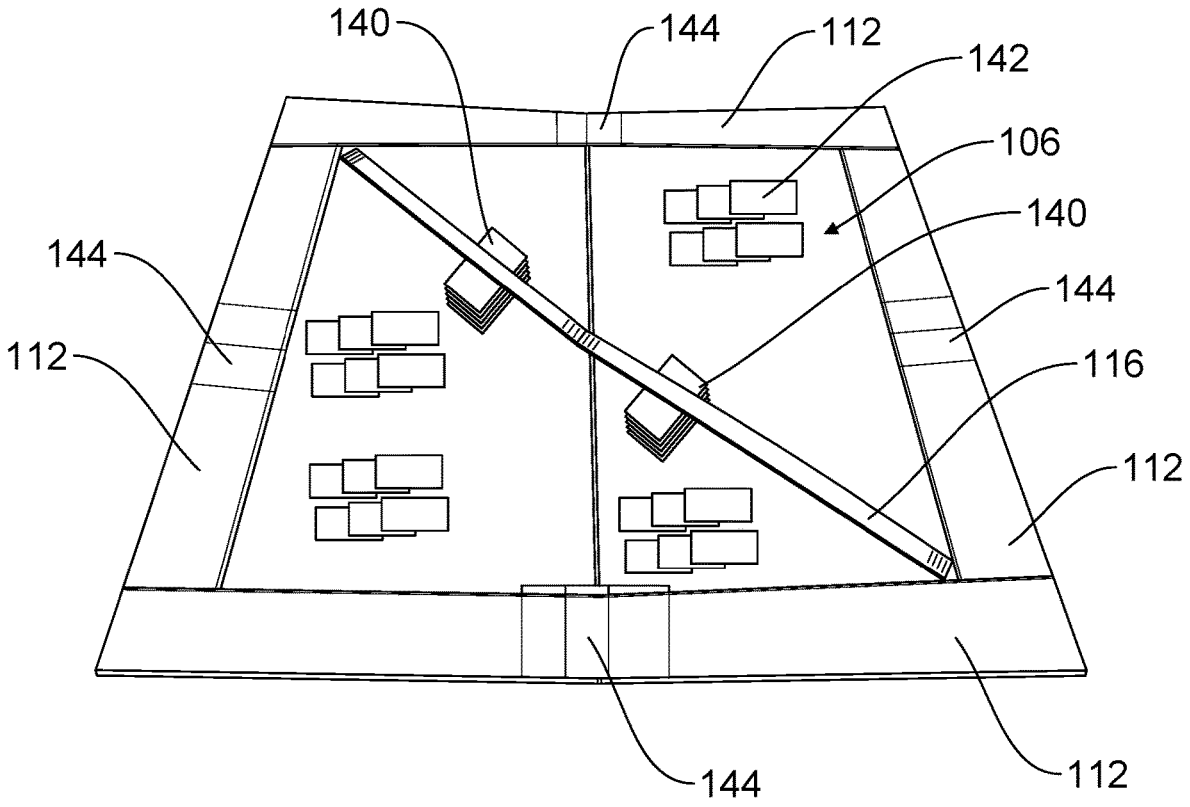
FIG. 5 illustrates the portable game board with playing card position markings, in accordance with embodiments of the invention.

The flexible band 116 is adapted to resist unintentional disengagement of a second plurality of playing cards 134 when the second plurality of playing cards 134 are respectively inserted between the elongated flexible band 116 and the inner playing surface 106, as illustrated in FIGS. 3 and 5.

Figure 4:
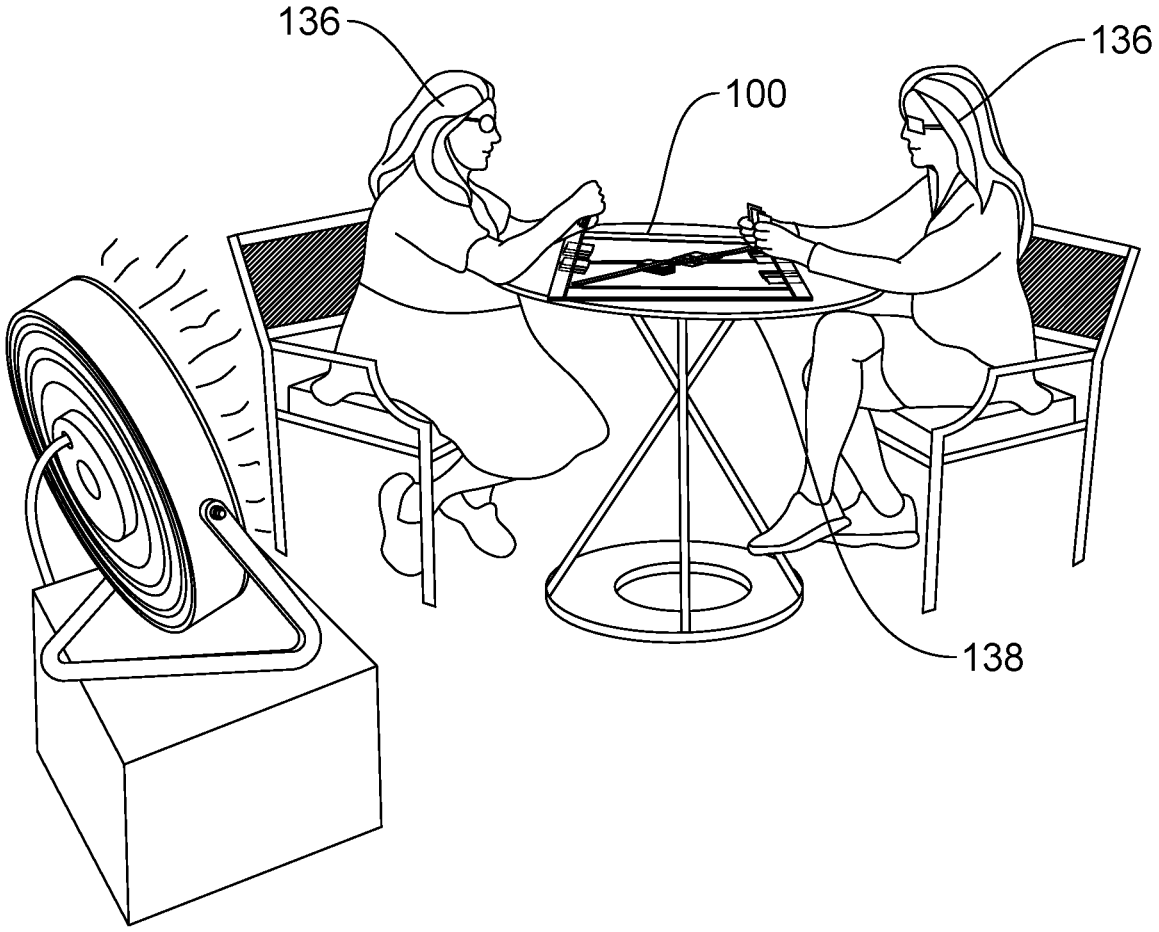
FIG. 4 illustrates players playing a card game outdoors using the portable game board in the open card playing position, in accordance with embodiments of the invention.

In use, referring to FIGS. 3-5, the portable game board 100 allows players 136 to play any card game outdoors such as near a pool, in a camp, at the beach, among other places, without fear of the playing cards 132,134 being blown away by wind. The flat card retention sleeves 112 secure the first plurality of playing cards 132 against unintentional disengagement from the inner playing surface 106 of the portable game board 100, and the flexible band 116 secures the second plurality of playing cards 134 against unintentional disengagement from the inner playing surface 106 of the portable game board 100, as shown in FIGS. 3-5. The flat card retention sleeves 112 and the flexible band 116 allow easy access to the playing cards 132,134 for a user 136 while preventing such unintentional disengagement of the playing cards 132,134 by wind, breeze, or a fan, which would otherwise obstruct the card game playing of the users 136. The portable game board 100 can be placed on any surface 138, such as a table, floor, ice chest and more, as exemplified in FIG. 4., with the portable game board 100 resting on its outer surface 108 in the open card playing position (Arrow A, FIG. 1).

Referring now to FIG. 5, the inner playing surface 106 can have one or more markings 140 disposed thereon for indicating locations adapted to receive the second plurality of playing cards 134. The markings 140 can be printed underneath the flexible band 116 on the inner playing surface 106. The inner playing surface 106 can have a game board layout 142 printed thereon and each flat card retention sleeves 112 can also have a respective location 144 for indicating locations adapted to receive respective playing cards 132, 134 of a user 136.

The first rigid planar body 102 and the second rigid planar body 104 of the portable game board 100 are preferably constructed of a PVC covered cardboard material. In other embodiments, the first rigid planar body 102 and the second rigid planar body 104 can be made of a material including but not limited to wood, plastic, cardboard, polypropylene, high density polyethylene, and/or leather. Other embodiments of the present invention are intended to include or otherwise cover any type of the material for the portable game board 100, including known, related art, and/or later developed materials.

The portable game board 100 is wind resistant as the flat card retention sleeves 112 and the flexible band 116 hold respective playing cards 132,134 in place. Further, the portable game board 100 is lightweight, portable, inexpensive to manufacture and therefore, is inexpensive to consumers.

Figure 6:
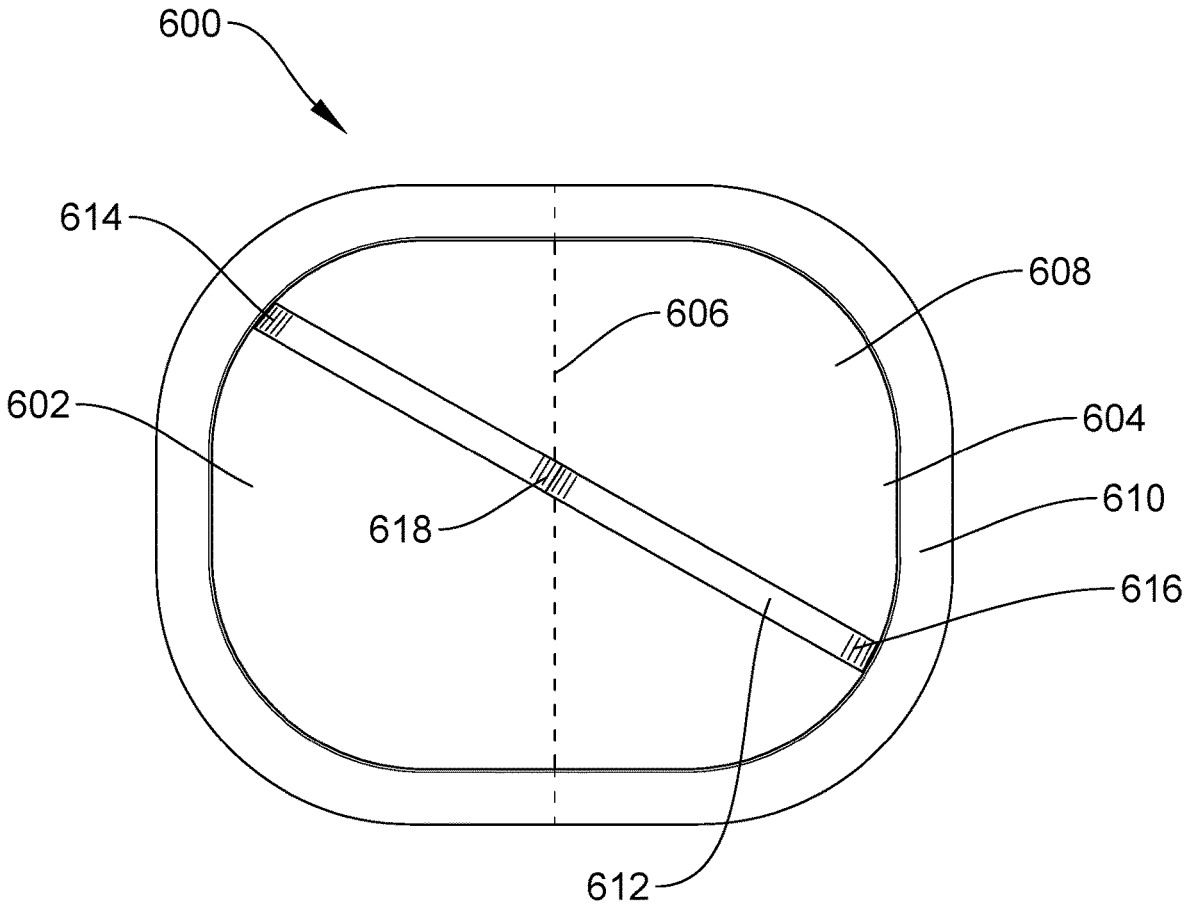
FIG. 6 is a round portable game board with semi-circular planar rigid bodies in an open card playing position, in accordance with embodiments of the invention.

Referring now to FIG. 6, another embodiment of the portable game board for card playing is disclosed. In such embodiment, the portable game board 600 comprises a superellipse shape in an open card playing position, illustrated in FIG. 6. In such embodiment, the superellipse shape is primarily rectangular in shape yet having rounded corners, as illustrated and further described herein. Preferably, the first rigid planar body 602 and the second rigid planar body 604 are each semi-elliptical in shape and are in coplanar alignment when in the open card playing position as shown in FIG. 6. In other words, in the open card playing position, the first rigid body 602 is in coplanar alignment with the second rigid 604 body and form a superellipse shape.

Figure 7:
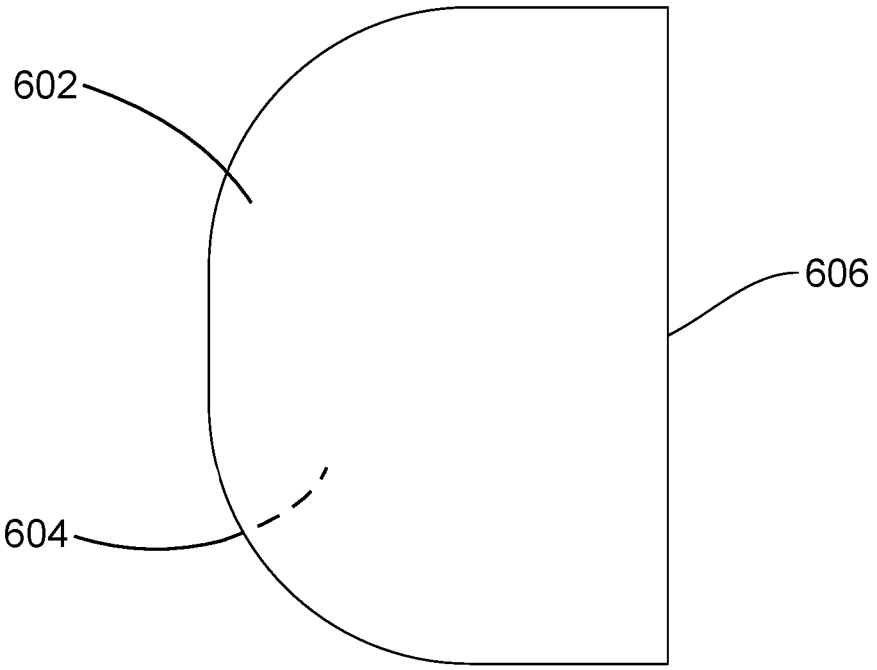
FIG. 7 illustrates the portable game board of FIG. 6 in a folded position, in accordance with embodiments of the invention.

In a preferred embodiment, the first rigid planar body 602 is pivotally movable relative to the second rigid planar body 604 along a folding seam 606 to transition the portable game board 600 into a folded or closed position, as illustrated in FIG. 7, in which the portable game board 600 is in a semi-elliptical shape, which is defined to be half of the superellipse shape. In a related embodiment, the first rigid planar body 602 and the second rigid planar body 604 are each semicircular in shape.

In another embodiment, the portable game board 600 comprises a round shape in an open card playing position. In yet another embodiment, the portable game board 600 comprises a squircle shape in an open card playing position. A squircle is a shape intermediate between a square and a circle. There are at least two definitions of "squircle" in use, the most common of which is based on the superellipse. A superellipse where the x and y radii are equal is sometimes also known as a supercircle and has also been called a squircle. The word "squircle" is a portmanteau of the words "square" and "circle".

Preferably, the first rigid planar body 602 and the second rigid planar body 604 of the portable game board 600 are constructed of a PVC covered cardboard material. In other embodiments, the first rigid planar body 602 and the second rigid planar body 604 can be made of a material including but not limited to wood, plastic, cardboard, polypropylene, high density polyethylene, and/or leather.

The inner playing surface 608 of the portable game board 600 includes a flat card retention sleeve 610 and an elongated flexible band 612 for securing plurality of playing cards as described in other embodiments of the present invention. The flat card retention sleeve 610 is disposed atop the inner playing surface 608 continuously around an outer edge of both the first rigid planar body 602 and the second rigid planar body 604, as illustrated in FIG. 6.

In one embodiment, the elongated flexible band 612 includes a first end 614, a second end 616 opposite the first end 614, and a middle portion 618 disposed between the first end 614 and the second end 616, wherein the first end 614, the middle portion 618 and the second 616 end are each respectively fixed to the inner playing surface 608 of the portable game board 600. In such embodiment, the elongated flexible band 612 of the portable game board 600 is like the flexible band 116 and is fixed to the inner playing surface 608 at the points 614-618, as illustrated in FIG. 6.

In another embodiment, the first end 614 and the second end 616 are each respectively fixed to the inner playing surface 608 of the portable game board 600, and the middle portion 618 is not fixed to the inner playing surface 608 of the portable game board 600, such that the middle portion 618 is disposed across the inner playing surface 608 where the middle portion 618 flexibly engages the inner playing surface 608 of the portable game board 600.

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise.

This invention is susceptible to considerable variation within the spirit and scope of the appended claims.

The claimed invention is:

1. A portable game board for card playing, comprising:

a first rigid planar body foldably connected to a second rigid planar body, said portable game board having an inner playing surface opposite an outer surface, the first and second rigid bodies pivotally moveable between a folded position, wherein the first rigid body opposes the second rigid planar body, to an open card playing position, wherein the first rigid body is in coplanar alignment with the second rigid body;

a plurality of flat card retention sleeves adapted to receive playing cards of a user, wherein each flat card retention sleeve is disposed atop the inner playing surface along a respective outer edge of the portable game board, such flat card retention sleeves adapted to resist unintentional disengagement of a first plurality of playing cards when inserted therein;

an elongated flexible band disposed across a top of the inner playing surface of the first rigid body and the second rigid body, said elongated flexible band adapted to resist unintentional disengagement of a second plurality of playing cards when inserted between the elongated flexible band and the inner playing surface;

said elongated flexible band having a first end, a second end, and a middle portion disposed between the first end and the second end, wherein the first end, the middle portion and the second end are each respectively fixed to the inner playing surface of the portable game board;

wherein the first end of the elongated flexible band is fixed to a first corner of the inner playing surface, wherein the middle portion is fixed to a center of the playing surface, wherein the second end is fixed to a second corner of the playing surface opposite the first corner.

2. The portable game board for card playing of claim 1, wherein the first rigid body and the second rigid body are each rectangular in shape, wherein in the open card playing position the portable game board is square in shape.

3. The portable game board for card playing of claim 1, wherein the first rigid body and the second rigid body are each semi-elliptical in shape, wherein in the open card playing position the portable game board comprises a superellipse shape.

4. The portable game board for card playing of claim 1, wherein said inner playing surface comprises a game board layout printed thereon.

5. The portable game board of claim 4, wherein the game board layout comprises a plurality of markings indicating respective locations adapted to receive respective game cards of a user.

6. The portable game board for card playing of claim 1, wherein each flat card retention sleeve is constructed of a flexible material.

7. The portable game board for card playing of claim 6, wherein each flat playing card retention sleeve is transparent.

8. The portable game board for card playing of claim 6, wherein each flat playing card retention sleeve is opaque.

9. A portable game board for card playing, comprising:

a first rigid planar body foldably connected to a second rigid planar body, said portable game board having an inner playing surface opposite an outer surface, the first and second rigid bodies pivotally moveable between a folded position, wherein the first rigid body opposes the second rigid planar body, to an open card playing position, wherein the first rigid body is in coplanar alignment with the second rigid body and the first rigid body and the second rigid body form a superellipse shape;

a flat card retention sleeve adapted to receive playing cards of a user, said flat card retention sleeve disposed atop the inner playing surface continuously around an outer edge of both the first rigid planar body and the second rigid planar body, said flat card retention sleeve adapted to resist unintentional disengagement of a first plurality of playing cards when inserted therein;

an elongated flexible band disposed across a top of the inner playing surface of the first rigid body and the second rigid body, said elongated flexible band adapted to resist unintentional disengagement of a second plurality of playing cards when inserted between the elongated flexible band and the inner playing surface;

said elongated flexible band having a first end, a second end, and a middle portion disposed between the first end and the second end, wherein the first end, the middle portion and the second end are each respectively fixed to the inner playing surface of the portable game board;

wherein the first end of the elongated flexible band is fixed to a first corner of the inner playing surface, wherein the middle portion is fixed to a center of the playing surface, wherein the second end is fixed to a second corner of the playing surface opposite the first corner.

10. The portable game board for card playing of claim 9, wherein said inner playing surface comprises a game board layout printed thereon.

11. The portable game board for card playing of claim 10, wherein the game board layout comprises a plurality of markings indicating respective locations adapted to receive respective game cards of a user.

12. The portable game board for card playing of claim 9, wherein the flat card retention sleeve is constructed of a flexible material.

13. The portable game board for card playing of claim 9, wherein each flat playing card retention sleeve is transparent.

14. The portable game board for card playing of claim 9, wherein each flat playing card retention sleeve is opaque.

* * * * *